US009636814B2

(12) United States Patent
Hecht et al.

(10) Patent No.: US 9,636,814 B2
(45) Date of Patent: May 2, 2017

(54) HAMMER MECHANISM

(75) Inventors: Joachim Hecht, Magstadt (DE); Martin Kraus, Filderstadt (DE)

(73) Assignee: Robert Bosch GMBH, Stuttgart (DE)

( * ) Notice: Subject to any disclaimer, the term of this patent is extended or adjusted under 35 U.S.C. 154(b) by 908 days.

(21) Appl. No.: 13/990,307

(22) PCT Filed: Oct. 14, 2011

(86) PCT No.: PCT/EP2011/067968

§ 371 (c)(1),
(2), (4) Date: Aug. 8, 2013

(87) PCT Pub. No.: WO2012/072327

PCT Pub. Date: Jun. 7, 2012

(65) Prior Publication Data

US 2013/0319709 A1 Dec. 5, 2013

(30) Foreign Application Priority Data

Nov. 29, 2010 (DE) ..... 10 2010 062 094

(51) Int. Cl.

| | |
|---|---|
| ***B25D 16/00*** | (2006.01) |
| ***B25D 11/00*** | (2006.01) |
| ***B25D 11/06*** | (2006.01) |
| ***B25F 5/00*** | (2006.01) |
| ***B25D 17/06*** | (2006.01) |

(52) U.S. Cl.

CPC ..... *B25D 16/00* (2013.01); *B25D 11/005* (2013.01); *B25D 11/062* (2013.01); *B25D 16/006* (2013.01); *B25D 17/06* (2013.01); *B25F 5/001* (2013.01); *B25D 2216/0023* (2013.01); *B25D 2216/0038* (2013.01); *B25D 2216/0069* (2013.01); *B25D 2217/0015* (2013.01); *B25D 2217/0023* (2013.01)

(58) Field of Classification Search

CPC .. B25D 11/005; B25D 11/106; B25D 16/003; B25D 16/006; B25D 16/062; B25D 2216/0023; B25D 2216/0015; B25D 2216/0038; B25D 2216/062; B25D 2250/095; B25D 2250/371; B25D 11/06; B25D 2250/3712; B25B 21/02

USPC ..... 173/48, 104, 109, 122, 204, 205, 216

See application file for complete search history.

(56) References Cited

U.S. PATENT DOCUMENTS

| | | | | |
|---|---|---|---|---|
| 3,203,490 | A * | 8/1965 | Short | B25D 16/00 173/109 |
| 4,280,359 | A * | 7/1981 | Schmid | B25D 11/062 173/109 |
| 4,325,436 | A * | 4/1982 | Richter | B25D 11/062 173/118 |

(Continued)

FOREIGN PATENT DOCUMENTS

| | | |
|---|---|---|
| DE | 3611890 | 10/1987 |
| EP | 0590352 | 4/1994 |

(Continued)

*Primary Examiner* — Scott A. Smith

(74) *Attorney, Agent, or Firm* — Gerard Messina

(57) ABSTRACT

A hammer mechanism having at least one impact-generation unit and a clamping chuck drive shaft is provided. The impact-generation unit includes a spur-gear transmission stage for translating a rotational speed of the clamping chuck drive shaft into a higher rotational speed for impact generation.

11 Claims, 8 Drawing Sheets

(56) References Cited

U.S. PATENT DOCUMENTS

| | | | | | |
|---|---|---|---|---|---|
| 4,456,076 | A * | 6/1984 | Schmid | B25D 11/062 | 173/201 |
| 4,567,950 | A * | 2/1986 | Fushiya | B25D 16/006 | 173/104 |
| 5,052,497 | A * | 10/1991 | Houben | B25D 11/005 | 173/109 |
| 5,277,259 | A * | 1/1994 | Schmid | B25D 16/003 | 173/109 |
| 5,320,177 | A * | 6/1994 | Shibata | B25D 17/00 | 173/109 |
| 5,337,835 | A * | 8/1994 | Bohne | B25D 11/005 | 173/109 |
| 5,366,025 | A * | 11/1994 | Dutschk | B25D 11/005 | 173/109 |
| 5,711,379 | A * | 1/1998 | Amano | B25D 11/106 | 173/109 |
| 6,112,830 | A * | 9/2000 | Ziegler | B25D 16/00 | 173/109 |
| 6,457,535 | B1 * | 10/2002 | Tanaka | B25B 21/00 | 173/178 |
| 6,460,627 | B1 * | 10/2002 | Below | B25D 16/006 | 173/109 |
| 6,843,330 | B2 * | 1/2005 | Schmid | B25D 16/00 | 173/109 |
| 7,287,600 | B2 * | 10/2007 | Braun | B25D 11/062 | 173/109 |
| 7,296,635 | B2 * | 11/2007 | Droste | B25D 11/062 | 173/104 |
| 7,395,872 | B2 * | 7/2008 | Duesselberg | B25D 16/006 | 173/109 |
| 7,410,007 | B2 * | 8/2008 | Chung | B25B 21/02 | 173/176 |
| 7,658,238 | B2 * | 2/2010 | Toukairin | B25D 17/24 | 173/178 |
| 7,705,497 | B2 * | 4/2010 | Arich | B25D 16/00 | 173/117 |
| 9,266,228 | B2 * | 2/2016 | Hecht | B25D 11/062 | |
| 2005/0194164 | A1 * | 9/2005 | Saito | B25D 11/005 | 173/48 |
| 2008/0011499 | A1 * | 1/2008 | Saur | B25D 16/006 | 173/109 |

FOREIGN PATENT DOCUMENTS

| | | |
|---|---|---|
| EP | 1834737 | 9/2007 |
| WO | WO 2011/000653 | 1/2011 |
| WO | WO2011/000654 | 1/2011 |
| WO | WO2011/000655 | 1/2011 |

* cited by examiner

HAMMER MECHANISM

BACKGROUND INFORMATION

Handheld machine tools having an impact-generation unit, in which a hammer is supported inside a hammer cylinder so as to be able to move, are already known. An intermediate shaft drives an impact-generation unit, and the hammer cylinder is driven at a lower rotational speed via a spur-gear transmission stage.

SUMMARY

A hammer mechanism is provided, which has at least one impact-generation unit and a clamping chuck drive shaft, the impact-generation unit having a spur-gear transmission stage for translating a rotational speed of the clamping chuck drive shaft into a higher rotational speed to produce the strikes. An "impact-generation unit" specifically denotes a unit provided to translate a rotary motion into an in particular translatory strike motion of a hammer means of the hammer mechanism, which is suitable for drilling or impact drilling. In particular, the impact-generation unit is developed as an impact-generation unit that is considered useful by the expert, but preferably as a pneumatic impact-generation unit and/or especially preferably, as an impact-generation unit having a rocker lever. A "rocker lever" in particular denotes a means which is supported so as to allow movement about a pivot axis and which is provided to output power, picked up in a first coupling area, to a second coupling area. A "clamping chuck drive shaft" in particular denotes a shaft which transmits a rotary motion from a gearing, especially a planetary gearing, in the direction of a clamping chuck in a drilling and/or impact drilling operation. Preferably, the clamping chuck drive shaft is at least partially developed as full shaft. The clamping chuck drive shaft preferably extends across at least 40 mm in the strike direction. In a drilling and/or impact drilling operation, the clamping chuck drive shaft and the clamping chuck preferably always have the same rotational speed, i.e., no gear unit is provided on a drive train between the clamping chuck drive shaft and the clamping chuck. A "strike direction" in particular denotes a direction which extends parallel to an axis of rotation of the clamping chuck and is directed from the hammer mechanism in the direction of the clamping chuck. Preferably, the strike direction is aligned parallel to an axis of rotation of the clamping chuck drive shaft. A "spur-gear transmission stage" in particular denotes a system of especially two toothed wheel works engaging with one another, which are supported so as to be rotatable about parallel axes. On a surface facing away from their axis, the toothed wheel works preferably have gear teeth. "Provided" in particular is to be understood as specially designed and/or equipped. A "rotational speed for impact generation" is a rotational speed of a drive means of the impact-generation unit that is considered useful by the expert, which translates a rotary motion into a linear motion. Preferably, the drive means of the impact-generation unit is developed as wobble bearing or, especially preferably, as an eccentric element. "Translate" in this case means that there is a difference in the rotational speed of the clamping chuck drive shaft and the rotational speed for the impact generation. Preferably, the rotational speed for an impact generation is higher, advantageously at least twice as high as the rotational speed of the clamping chuck drive shaft. Especially preferably, a translation ratio between the rotational speed for impact generation and the rotational speed of the clamping chuck drive shaft is a non-integer ratio. Because of the development of the hammer mechanism according to the present invention, an especially advantageous ratio between the rotational speed and the number of impacts of an inserted tool is able to be achieved in a space-saving and constructionally simple manner.

In another development, the impact-generation unit has a hammer mechanism shaft whose axis of rotation is disposed next to the clamping chuck drive shaft in the radial direction, which makes for an especially effective and low-vibration strike generation. Using simple design measures, in particular, an especially advantageous lever effect of the rocker lever is achievable. A "hammer mechanism shaft" in particular denotes a shaft which mounts at least a portion of the drive means of the impact-generation unit in a manner allowing a rotation about an axis. In an impact drilling operation, the hammer mechanism shaft preferably outputs power only to the drive means, which power is acting at least partially on a workpiece. In particular, the hammer mechanism shaft outputs no power to the clamping chuck that drives the clamping chuck in rotational manner. The term "disposed next to the clamping chuck drive shaft in the radial direction" in particular means that the clamping chuck drive shaft and the hammer mechanism shaft are mounted so as to be rotatable about two axes of rotation disposed parallel to each other, in particular. At least one plane aligned perpendicularly to the axes of rotation preferably intersects the clamping chuck drive shaft and the hammer mechanism shaft.

Furthermore, the impact-generation unit has at least one bearing for mounting the hammer mechanism shaft in axially fixated manner, thereby resulting in an especially minimal construction outlay. In this context a "bearing" in particular describes a means for mounting the impact-generation unit in a way that allows it to rotate about an axis of rotation in relation to a housing. In particular, the phrase "axially fixed in place" means that the bearing supports the hammer mechanism shaft relative to the housing in a direction parallel to the axis of rotation, but does not allow any movement.

In one advantageous development of the present invention, the impact-generation unit includes a hammer means which in at least one operating state is supported by the clamping chuck drive shaft so as to allow movement in the strike direction, thereby providing lower weight and a smaller size. A "hammer means" in particular denotes a means of the hammer mechanism which is meant to be accelerated by the impact-generation unit during operation, in particular in translatory fashion, and to output a pulse, picked up during the acceleration, in the form of a strike pulse in the direction of an inserted tool. Preferably, the hammer means is supported by air pressure or advantageously by a rocker lever, in a way that allows it to be accelerated in the strike direction. Directly prior to a strike, the hammer means preferably is in a non-accelerated state. During a strike, the hammer means preferably applies a strike pulse in the direction of the inserted tool, in particular via a snap die. The term "support so as to be movable" specifically means that the clamping chuck drive shaft has a bearing surface which in at least one operating state transmits bearing forces to the strike mechanism, perpendicularly to the strike direction.

Furthermore, it is provided that the clamping chuck drive shaft at least partially penetrates the hammer means, so that a clamping chuck drive shaft having an especially low mass and a small space requirement is able to be provided. The phrase "at least partially penetrate" in particular means that the hammer means encloses the clamping chuck drive shaft by more than 270 degrees, advantageously by 360 degrees on at least one plane which advantageously is oriented perpendicularly to the strike direction. Preferably, the hammer means is mounted on the clamping chuck drive shaft in form-fitting manner in a direction perpendicular to the axis of rotation of the clamping chuck drive shaft, i.e., supported in movable manner in the direction of the axis of rotation.

In addition, it is provided that the hammer mechanism includes at least one bearing for mounting the clamping chuck drive shaft in axially displaceable manner, thereby providing a hammer mechanism deactivation which is simple to produce. A "bearing" in this context describes a device which mounts the clamping chuck drive shaft in particular in relation to the housing in a manner that allows it to move at least about the axis of rotation. In particular, the phrase "axially displaceable" means that the bearing mounts the clamping chuck drive shaft in a manner that allows it to move, especially relative to the housing, parallel to the strike direction. Preferably, a connection of the coupling means of the clamping chuck drive shaft driving the impact-generation unit is reversible by axial shifting of the clamping chuck drive shaft.

It is furthermore provided that the hammer mechanism includes a planetary gearing, which drives the clamping chuck drive shaft in at least one operating state, so that an advantageous translation is able to be achieved in a space-saving manner. Moreover, a torque restriction and a plurality of gear stages are realizable by simple design measures. A "planetary gearing" in particular means a unit having at least one planetary wheel set. A planetary wheel set preferably includes a sun gear, a ring gear, a planetary wheel carrier and at least one planetary wheel which is guided by the planetary wheel carrier along a circular path about the sun gear. Preferably, the planetary gearing has at least two translation ratios, selectable by the operator, between an input and an output of the planetary gearing.

Furthermore, the hammer mechanism has a clamping chuck and a snap die provided with coupling means for transmitting a rotary motion to the clamping chuck, so that an especially compact hammer mechanism is able to be made available. The snap die advantageously transmits a rotary motion of the clamping chuck drive shaft to the clamping chuck. The term "clamping chuck" in particular describes a device for the direct mounting of the inserted tool in at least torsionally fixed manner, such that it is able to be detached by a user, in particular without employing a tool. A "snap die" in particular means an element of the hammer mechanism that transmits the strike pulse from the hammer in the direction of the inserted tool during a strike. The snap die preferably strikes the inserted tool directly in at least one operating state. The snap die preferably prevents dust from entering the hammer mechanism through the clamping chuck. "Coupling means" in particular denotes means provided to transmit a motion from one component to another component by at least a keyed connection. The keyed connection preferably allows the user to reverse the connection in at least one operating state. In an especially preferred manner, the keyed connection is reversible for switching an operating mode, i.e., advantageously between a screwing operation, a drilling operation, a cutting operation and/or an impact drilling operation. The coupling means in particular is developed as a coupling considered useful by the expert, but advantageously as a dog clutch and/or toothing. In an advantageous manner, the coupling means includes a plurality of keyed connection elements and a region that connects the keyed connection elements.

Furthermore, the hammer mechanism includes a coupling means which is connected to the clamping chuck drive shaft in torsionally fixed manner and provided to drive the impact-generation unit, thereby providing an especially compact and powerful hammer mechanism in a simple manner in terms of production. "In torsionally fixed manner" in particular means that the coupling means and the clamping chuck drive shaft are fixedly connected to each other in at least the circumferential direction, preferably in all directions, i.e., in particular in all operating states. "Drive" in this context in particular means that the coupling means transmits kinetic energy, in particular rotational energy, to at least one region of the impact-generation unit. The impact-generation unit preferably uses this energy to drive the hammer means. The development according to the present invention makes it possible to provide an especially compact and powerful hammer mechanism using constructionally simple measures.

Moreover, the hammer mechanism includes an impact-generation deactivation unit having a blocking element which in at least a drilling operation and especially in a screw-fitting operation, acts on the snap die, parallel to at least one force of the clamping chuck drive shaft, so that an advantageous placement of an operating element of the impact-generation deactivation unit is possible by constructionally simple measures. Especially an annular operating element, which encloses the snap die or the clamping chuck drive shaft, is easily able to be realized. In addition, this development requires little space. An "impact-generation deactivation unit" in particular means a unit provided to allow an operator to switch off the impact-generation unit for drilling and/or screw-fitting. Preferably, the impact-generation deactivation unit prevents an especially automatic activation of the impact-generation unit when the inserted tool is pressed against a workpiece in a drilling and/or screw-fitting mode. The pressure application in a cutting and/or impact drilling mode preferably causes an axial displacement of the clamping chuck drive shaft. In an advantageous manner, the blocking element is provided to prevent an axial displacement of the clamping chuck drive shaft, the clamping chuck and/or advantageously, the snap die in the drilling and/or screw-fitting mode. "Parallel to a force" in particular means that the clamping chuck drive shaft and the blocking element apply a force to the snap die at two different locations in at least one operating state.

As an alternative or in addition, the clamping chuck drive shaft and the blocking element are able to exert a force on the clamping chuck at two different locations in at least one operating state. The forces preferably have a component that is aligned in the same direction, i.e., preferably parallel to the axis of rotation of the clamping chuck drive shaft, from the clamping chuck drive shaft in the direction of the clamping chuck. The blocking element preferably acts directly on the snap die, but especially preferably, at least via a clamping chuck bearing. The clamping chuck drive shaft preferably acts directly on the snap die. The snap die preferably transmits a rotary motion of the clamping chuck drive shaft to the clamping chuck.

Furthermore, the hammer mechanism includes a torque-restriction device for restricting a torque that is maximally transmittable via the clamping chuck drive shaft, so that the operator is advantageously protected and the handheld tool is able to be used in a comfortable and safe manner to perform screw-fitting operations. "Restrict" in this context in particular means that an exceeding of the maximum torque adjustable by an operator, in particular, is prevented by the torque-restriction device. Preferably, the torque-restriction device opens a connection between a drive motor and the clamping chuck, which is torsionally fixed during operation. As an alternative or in addition, the torque-restriction device may act on an energy supply of the drive motor.

Moreover, a handheld tool which includes a hammer mechanism according to the present invention is provided. A "handheld tool" in this context in particular denotes a handheld tool that appears useful to an expert, but preferably a drilling machine, an impact drill, a screw driller, a boring tool and/or a percussion drill. The handheld tool preferably is developed as battery-operated handheld tool, i.e., the handheld tool in particular includes a coupling means provided to supply a drive motor of the handheld tool with electrical energy from a handheld tool battery pack connected to the coupling means.

DETAILED DESCRIPTION

Figure 1:
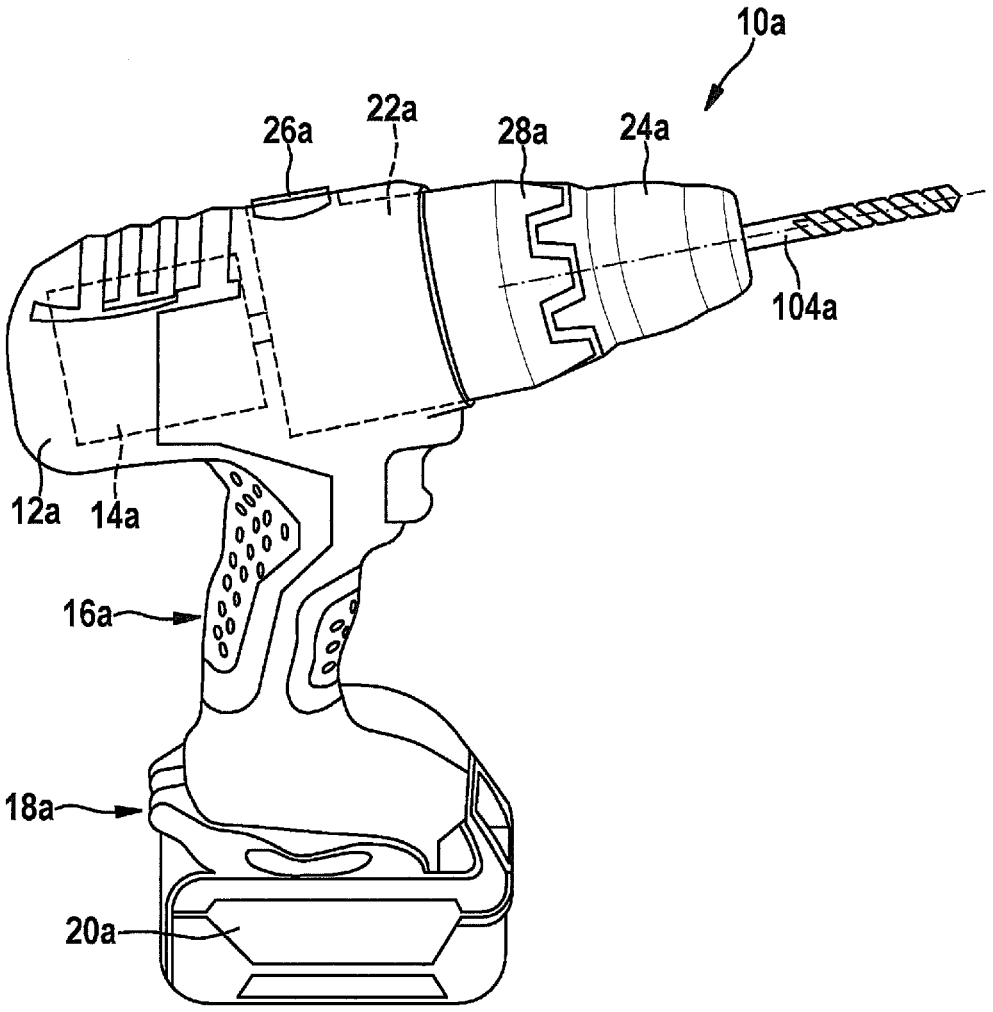
FIG. 1 shows a handheld tool having a hammer mechanism according to the present invention, in a perspective view.

FIG. 1 shows a handheld tool 10*a*, which is developed as impact drill screwer. Handheld tool 10*a* has a pistol-shaped housing 12*a*. A drive motor 14*a* of handheld tool 10*a* is situated inside housing 12*a*. Housing 12*a* has a handle region 16*a* and a battery coupling means 18*a*, which is disposed at an end of handle region 16*a* facing away from drive motor 14*a*. Battery coupling means 18*a* links a handheld tool battery 20*a* in a manner that allows an operator to sever the link electrically or mechanically. Handheld tool battery 20*a* has an operating voltage of 10.8 Volt, but could also have a different, especially higher, operating voltage. Furthermore, handheld tool 10*a* has a hammer mechanism 22*a* according to the present invention, which includes a clamping chuck 24*a* disposed on the outside, and operating elements 26*a*, 28*a*.

Figure 2:
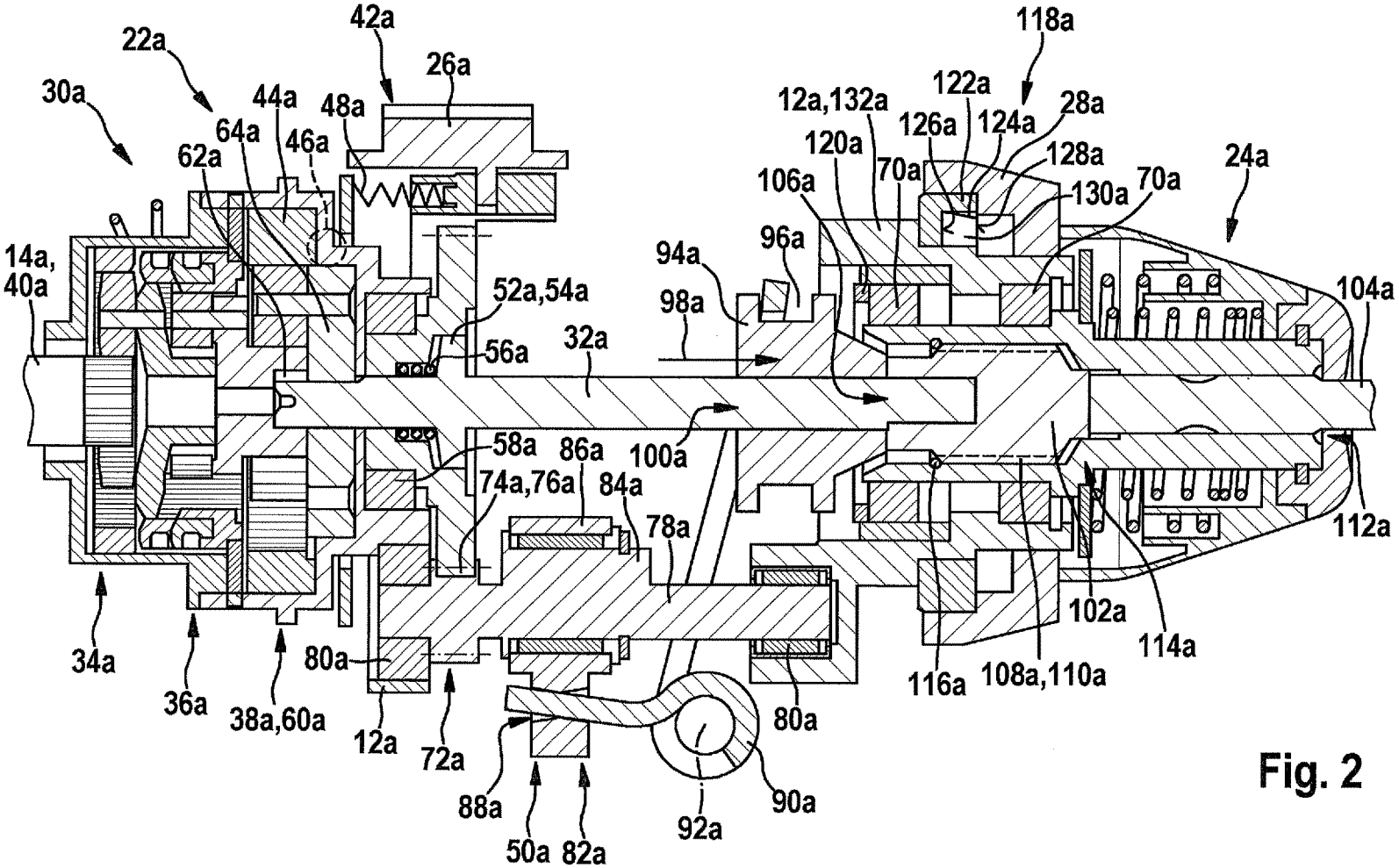
FIG. 2 shows a section of the hammer mechanism of FIG. 1.

FIG. 2 shows hammer mechanism 22*a* in a sectional view. Hammer mechanism 22*a* also includes a planetary gearing 30*a* and a clamping chuck drive shaft 32*a*. When in operation, planetary gearing 30*a* drives clamping chuck drive shaft 32*a* to execute rotary motions about an axis of rotation. To do so, planetary gearing 30*a* has three planetary gear stages 34*a*, 36*a*, 38*a*. An operator is able to adjust a transmission ratio of planetary gearing 30*a* between a rotor 40*a* of drive motor 14*a* and clamping chuck drive shaft 32*a* in at least two stages. As an alternative, a transmission ratio between drive motor 14*a* and clamping chuck drive shaft 32*a* could also be designed not to be adjustable.

Hammer mechanism 22*a* has a torque restriction device 42*a*. Torque restriction device 42*a* keeps a ring gear 44*a* of planetary gearing 30*a* fixated during a working process. Toward this end, torque restriction device 42*a* includes fixation balls 46*a*, which engage with recesses of ring gear 44*a*. A spring 48*a* of torque restriction device 42*a* exerts a force on fixation balls 46*a* in the direction of ring gear 44*a* in the process. An operator is able to move an end of spring 48*a* facing fixation balls 46*a* in the direction of fixation balls 46*a* by means of one of operating elements 26*a*. Operating element 26*a* is provided with an eccentric element for this purpose. Thus, the force acting on fixation balls 46*a* is adjustable. If a particular maximum torque has been reached, fixation balls 46*a* are pressed out of the recesses, and ring gear 44*a* runs freely, so that a force transmission between rotor 40*a* and clamping chuck drive shaft 32*a* is interrupted. Torque restriction device 42*a* thus is provided to restrict a maximum torque transmittable via clamping chuck drive shaft 32*a*.

Figure 3:
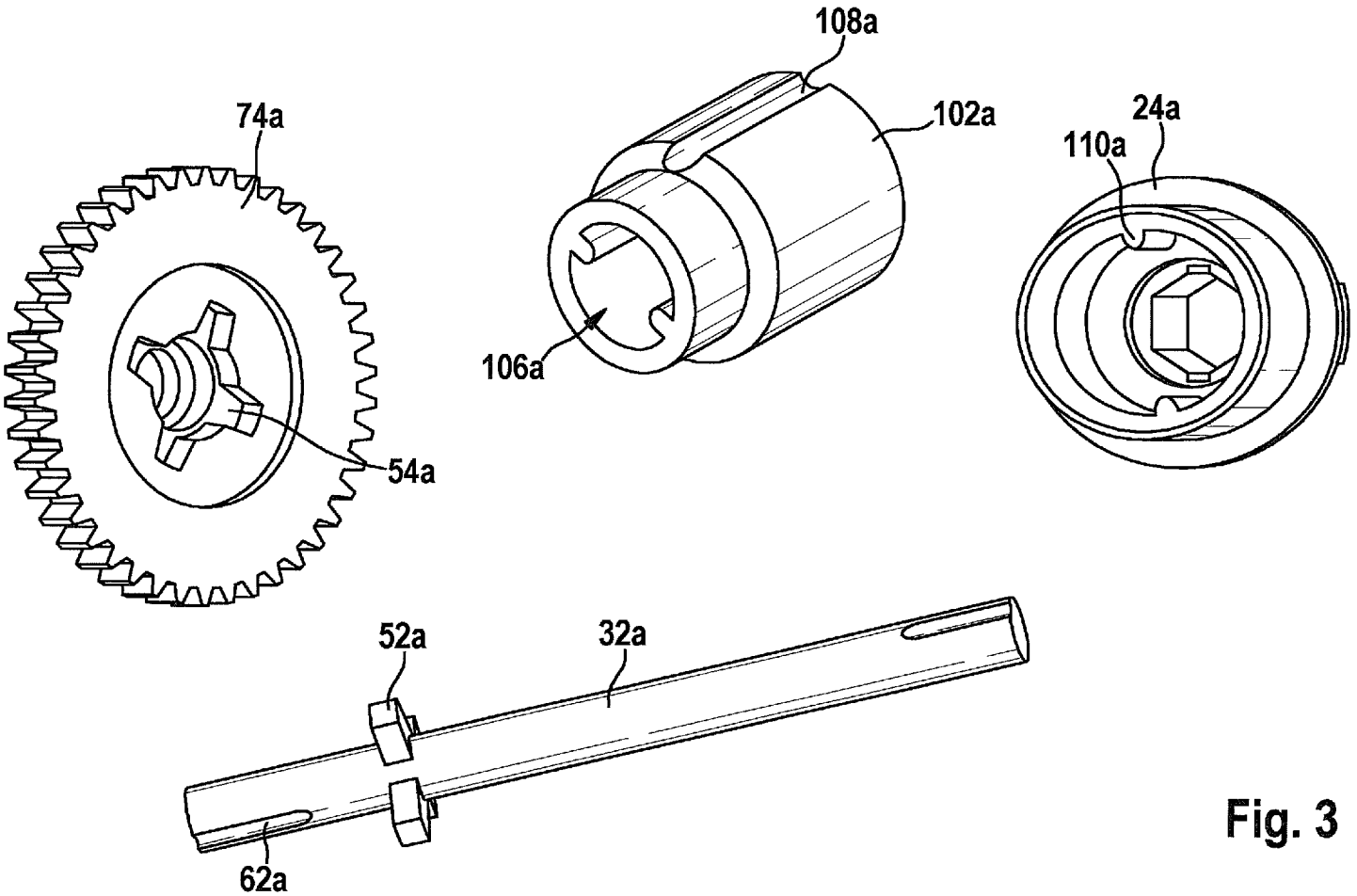
FIG. 3 shows a coupling arrangement, clamping chuck drive shaft, snap die, and a portion of a clamping chuck of the hammer mechanism from FIG. 1, shown individually in a perspective view.

Hammer mechanism 22*a* has an impact-generation unit 50*a* and a first coupling means 52*a*. First coupling means 52*a* is connected to clamping chuck drive shaft 32*a* in torsionally fixed manner, first coupling means 52*a* and clamping chuck drive shaft 32*a* being formed in one piece, in particular. Impact-generation unit 50*a* includes a second coupling means 54*a*, which is connected to first coupling means 52*a* in torsionally fixed manner during a drilling and/or impact drilling mode. As shown in FIG. 3 as well, first coupling means 52*a* is developed in the form of premolded shapes and second coupling means 54*a* as recesses. When the drilling mode is activated, first coupling means 52*a* dips into second coupling means 54*a*, i.e., to the full extent. As a result, the coupling between first coupling means 52*a* and second coupling means 54*a* is reversible by axial shifting of clamping chuck drive shaft 32*a* in the direction of clamping chuck 24*a*. A spring 56*a* of hammer mechanism 22*a* is situated between first coupling means 52*a* and second coupling means 54*a*. Spring 56*a* presses clamping chuck drive shaft 32*a* in the direction of clamping chuck 24*a*. When impact-generation unit 50*a* is deactivated, it opens the linkage between first coupling means 52*a* and second coupling means 54*a*.

Hammer mechanism 22*a* has a first bearing 58*a*, which fixates second coupling means 54*a* relative to housing 12*a* in the axial direction and rotationally mounts it in coaxial manner with respect to clamping chuck drive shaft 32*a*. Furthermore, hammer mechanism 22*a* has a second bearing 60*a*, which rotationally mounts clamping chuck drive shaft 32*a* on a side facing drive motor 14*a*, such that it is able to rotate about the axis of rotation. Second bearing 60*a* is integrally formed with one of the three planetary gear stages. Clamping chuck drive shaft 32*a* includes a coupling means 62*a*, which connects it to a planet carrier 64*a* of this planetary gear stage 38*a* in axially displaceable and torsionally fixed manner. As a result, planetary gear stage 38*a* is provided to support clamping chuck drive shaft 32 in axially displaceable manner. On a side facing clamping chuck 24*a*, clamping chuck drive shaft 32*a* together with clamping chuck 24*a* is rotationally mounted by a clamping chuck bearing 70*a*. Clamping chuck bearing 70*a* has a rear bearing element, which is pressed onto clamping chuck 24*a* in axially fixated manner. In addition, clamping chuck bearing 70*a* has a front bearing element which supports clamping chuck 24*a* inside housing 12*a* in axially displaceable manner.

Impact-generation unit 50*a* includes a spur-gear transmission stage 72*a*, which translates a rotational speed of clamping chuck drive shaft 32*a* into a higher rotational speed for impact generation. A first toothed wheel 74*a* of spur-gear transmission stage 72*a* is integrally formed with second coupling means 54*a*. In an impact drilling operation, it is driven by clamping chuck drive shaft 32*a*. A second toothed wheel 76*a* of spur-gear transmission stage 72*a* is integrally formed with a hammer mechanism shaft 78*a*. An axis of rotation of hammer mechanism shaft 78*a* is disposed next to the axis of rotation of clamping chuck drive shaft 32*a* in the radial direction. Impact-generation unit 50*a* has two bearings 80*a*, which mount hammer mechanism shaft 78*a* in axially fixed and rotatable manner. Impact-generation unit 50*a* is provided with a drive means 82*a*, which translates a rotary motion of impact mechanism shaft 78*a* into a linear motion. An eccentric element 84*a* of drive means 82*a* is integrally formed with impact mechanism shaft 78*a*. Using a needle roller bearing, an eccentric sleeve 86*a* of drive means 82*a* is rotationally mounted on eccentric element 84*a* so as to be rotatable relative to eccentric element 84*a*. Eccentric sleeve 86*a* has a recess 88*a*, which encloses a rocker lever 90*a* of impact-generation unit 50*a*.

Rocker lever 90*a* is mounted in pivotable manner on a pivot axle 92*a* of impact-generation unit 50*a*, that is to say, it is pivotable about an axis that runs perpendicularly to the axis of rotation of clamping chuck drive shaft 32*a*. An end of rocker lever 90*a* facing away from drive means 82*a* partially encloses a hammer means 94*a* of hammer mechanism 22*a*. The rocker lever engages with a recess 96*a* of hammer means 94*a* in the process. Recess 96*a* is developed in the form of a ring. When operated as impact drill, rocker lever 90*a* exerts a force on hammer means 94*a*, which accelerates the hammer means. Rocker lever 90*a* is moved in a sinusoidal pattern during operation. Rocker lever 90*a* has a flexible design. It has a spring constant between eccentric sleeve 86*a* and hammer 90*a* that is less than 100 N/mm and greater than 10 N/mm. In this exemplary embodiment, rocker lever 98*a* has a spring constant of approximately 30 N/mm.

Clamping chuck drive shaft 32*a* mounts hammer means 94*a* in a manner that allows it to move in strike direction 98*a*. To do so, hammer means 94*a* delimits a recess 100*a*. Clamping chuck drive shaft 32*a* penetrates hammer means 94*a* through recess 100*a*. In the process, hammer means 94*a* encloses recess 100*a* in a plane perpendicular to recess 100*a* to 360 degrees. When operated, hammer means 94*a* strikes a snap die 102*a* of hammer mechanism 22*a*. Snap die 102*a* is situated between an inserted tool 104*a* and hammer means 94*a*. In an operative state, inserted tool 104*a* is fixed in place in clamping chuck 24*a*. Clamping chuck 24*a* mounts snap die 102*a* so as to allow movement parallel to strike direction 98*a*. In an impact drilling operation, snap die 102*a* transmits hammer pulses originating from hammer means 94*a* to inserted tool 104*a*.

Clamping chuck drive shaft 32*a* is connected to snap die 102*a* in axially movable and torsionally fixed manner. Snap die 102*a* delimits a recess 106*a* for this purpose. When in an operative state, clamping chuck drive shaft 32*a* is partially situated in recess 106*a* of snap die 102*a*. Clamping chuck drive shaft 32*a* is rotationally mounted via snap die 102*a*, clamping chuck 24*a*, and clamping chuck bearing 70*a*. Clamping chuck 24*a* is rotationally driven via snap die 102*a*. For this purpose, clamping chuck 24*a* and snap die 102*a* each include coupling means 108*a*, 110*a*, which are provided to transmit the rotary motion to clamping chuck 24*a*. Coupling means 108*a* of snap die 102*a* is developed as groove, whose main extension is situated parallel to strike direction 98*a*. Coupling means 108*a* extends along a radially outward-lying surface area of snap die 102*a*. Coupling means 110*a* of clamping chuck 24*a* thus is developed as a raised region that fits the groove.

Clamping chuck 24*a* has an inserted-tool coupling region 112*a*, in which inserted tool 104*a* is fixed in strike direction 98*a* during a drilling a screw-drilling operation, or in which region it is mounted in movable manner in strike direction 98*a* during an impact-drilling operation. In addition, the clamping chuck has a tapered region 114*a*, which delimits a movement range of snap die 102*a* in strike direction 98*a*. Furthermore, clamping chuck 24*a* includes a mounting ring 116*a*, which delimits a movement range of snap die 102*a* counter to strike direction 98*a*.

During an impact drilling operation, an operator presses inserted tool 104*a* against a workpiece (not shown further). The operator thereby shifts inserted tool 104*a*, snap die 102*a* and clamping chuck drive shaft 32*a* relative to housing 12*a*, in a direction opposite to the strike direction 98*a*, i.e., in the direction of drive motor 14*a*. In so doing, the operator compresses spring 56*a* of hammer mechanism 22*a*. First coupling means 52*a* dips into second coupling means 54*a*, so that clamping chuck drive shaft 32*a* begins to drive impact-generation unit 50*a*. When the operator stops pressing inserted tool 104*a* against the workpiece, spring 56*a* shifts clamping chuck drive shaft 32*a*, snap die 102*a* and inserted tool 104*a* in strike direction 98*a*. This opens a torsionally fixed connection between first coupling means 52*a* and second coupling means 54*a*, so that impact-generation unit 50*a* is switched off.

Hammer mechanism 22*a* has an impact-generation deactivation unit 118*a* including a blocking element 120*a*, a sliding block guide 122*a*, and operating element 28*a*. In a drilling or screwing mode, blocking element 120*a* exerts a force on snap die 102*a*, which acts on snap die 102 parallel to at least one force of clamping chuck drive shaft 32*a*. The force of blocking element 120*a* acts on snap die 102*a* via clamping chuck bearing 70*a*, via clamping chuck 24*a*, and via mounting ring 116*a*. The force of blocking element 120*a* prevents an axial displacement of snap die 102*a* and clamping chuck drive shaft 32*a* during a drilling and screwing mode, and thus prevents an activation of impact-generation unit 50*a*. The force of clamping chuck drive shaft 32*a* has a functionally parallel component which drives snap die 102*a* in rotating fashion during operation. In addition, the force has a functionally and directionally parallel component which is brought to bear on snap die 102*a* by spring 56*a* by way of clamping chuck drive shaft 32*a*.

Figure 4:
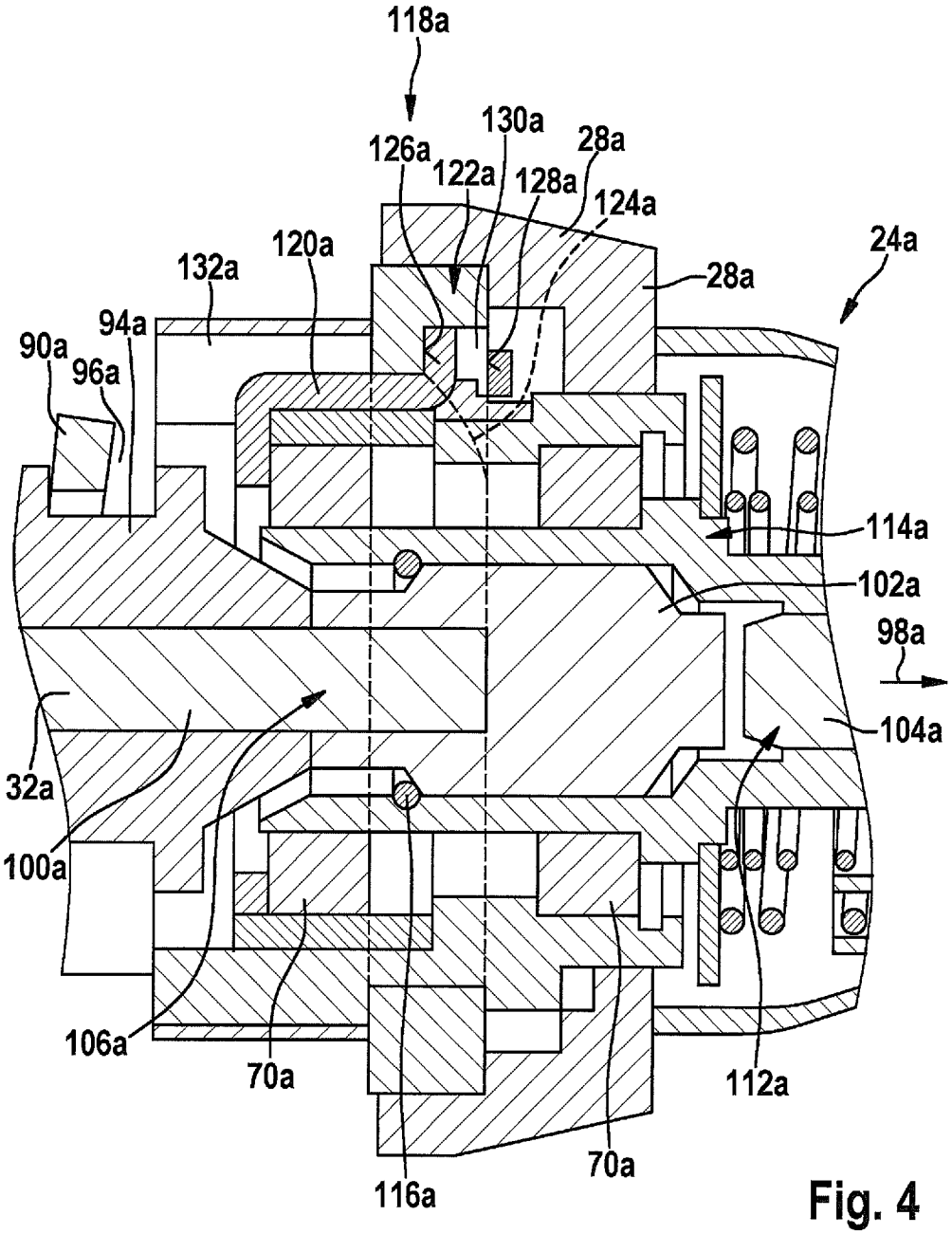
FIG. 4 shows another part-sectional view of the hammer mechanism from FIG. 1, which shows an impact-generation deactivation unit of the hammer mechanism.

FIG. 4 shows a section that runs perpendicularly to the section of FIG. 2 and parallel to strike direction 98*a*, operating element 28*a* being disposed in two different positions in the sections of FIGS. 2 and 4. Operating element 28*a* is developed in the shape of a ring. It coaxially encloses the axis of rotation of clamping chuck drive shaft 32*a*. Operating element 28*a* is mounted so as to allow a rotation. It is connected to sliding block guide 122*a* in torsionally fixed manner. Sliding block guide 122*a* is likewise developed in the form of a ring. Sliding block guide 122*a* includes a bevel 124*a*. Bevel 124*a* joins two surfaces 126*a*, 128*a* of sliding block guide 122*a*. Surfaces 126*a*, 128*a* are aligned perpendicularly to strike direction 98*a*. Surfaces 126*a*, 128*a* are disposed on different planes in strike direction 98*a*.

In an impact drilling mode, blocking element 120*a* is situated in a recess 130*a*, which, for one, is delimited by bevel 124*a* and one of surfaces 126*a*. This surface 126*a* is situated closer to drive motor 14*a* than the other surface 128*a*. Housing 12*a* includes a housing element 132*a*, which mounts the blocking element in torsionally fixed manner and allows it to be displaced in strike direction 98*a*. At the beginning of an impact-drilling operation, blocking element 120*a*, together with clamping chuck 24*a*, is therefore able to be pressed in a direction counter to strike direction 98*a*. Blocking element 120*a* does not exert any blocking force on clamping chuck 24*a* in an impact-drilling operation. When operating element 28*a* of impact-generation deactivation unit 118*a* is rotated, blocking element 120*a* is moved through bevel 124*a* in strike direction 98*a*. In the drilling or screwing mode, blocking element 120*a* is kept in this frontal position. Blocking element 120*a* thereby prevents axial shifting of clamping chuck drive shaft 32*a* in the drilling or screwing mode.

FIGS. 5 through 11 show additional exemplary embodiments of the present invention. The following descriptions and the drawing are essentially limited to the differences between the exemplary embodiments. Regarding components that are designated in the same way, particularly regarding components provided with identical reference numerals, it is basically also possible to refer to the drawing and/or the description of the other exemplary embodiments, especially of FIGS. 1 through 4. In order to distinguish the exemplary embodiments, the letter a has been added after the reference numerals of the exemplary embodiment in FIGS. 1 through 4. In the exemplary embodiments of FIGS. 5 through 11, the letter a has been replaced by the letter b or by the letters b through e.

Figure 5:
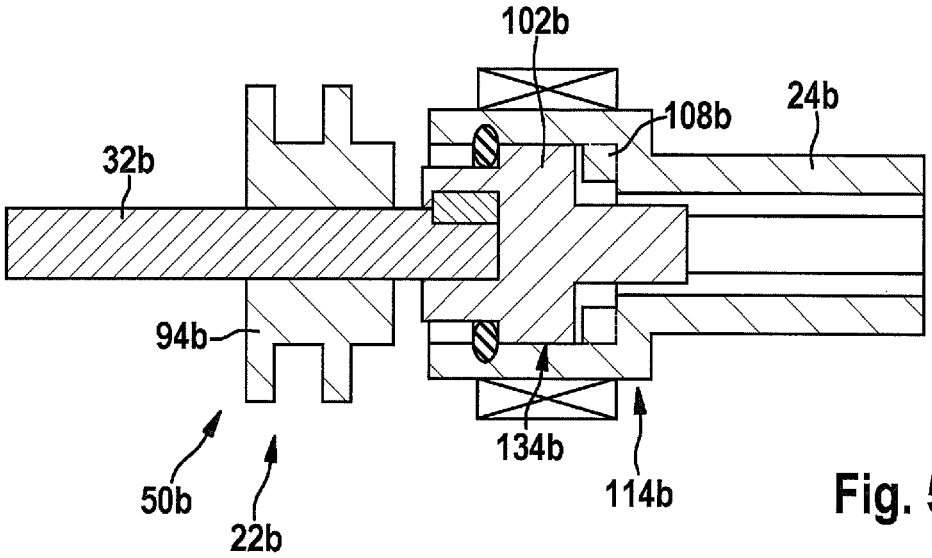
FIG. 5 shows a first alternative exemplary embodiment of a snap die of the hammer mechanism from FIG. 1 in a schematic representation.

FIG. 5 shows a portion of a hammer mechanism 22*b*. A hammer means 94*b* of an impact-generation unit 50*b* of hammer mechanism 22*b* is mounted in movable manner on a clamping chuck drive shaft 32*b* of hammer mechanism 22*b*. Clamping chuck drive shaft 32*b* is joined to a snap die 102*b* of hammer mechanism 22*b* in torsionally fixed and axially displaceable manner. Snap die 102*b* includes a coupling means 108*b*, which forms a torsionally fixed connection to a clamping chuck 24*b* of hammer mechanism 22*b* in at least one operating state. Coupling means 108*b* is situated on a side that is facing a tapered region 114*b* of clamping chuck 24*b*. Coupling means 108*b* is developed as teething. A sealing region 134*b* of the snap die is resting against clamping chuck 24*b* without teeth and advantageously prevents dust from entering impact-generation unit 50*b*.

Figure 6:
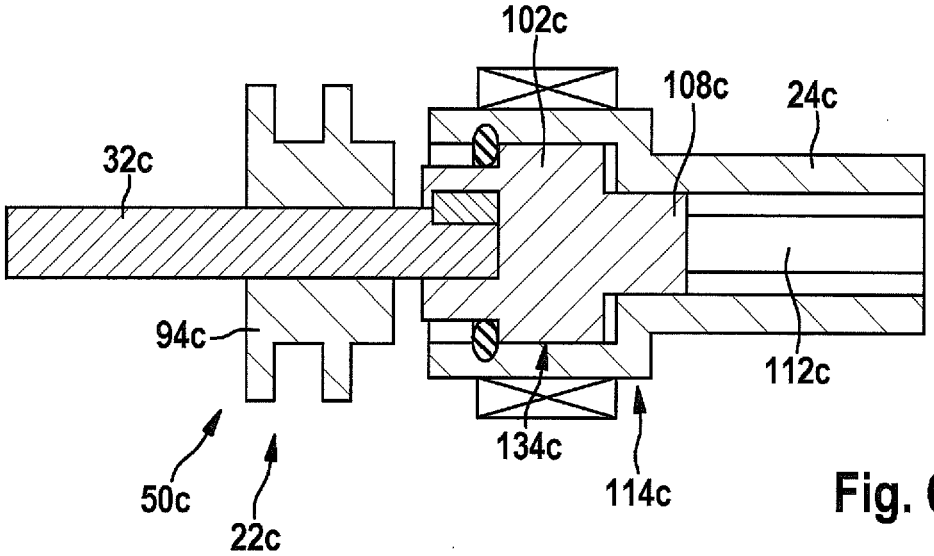
FIG. 6 shows a second alternative exemplary embodiment of a snap die of the hammer mechanism from FIG. 1 in a schematic representation.
Figure 7:
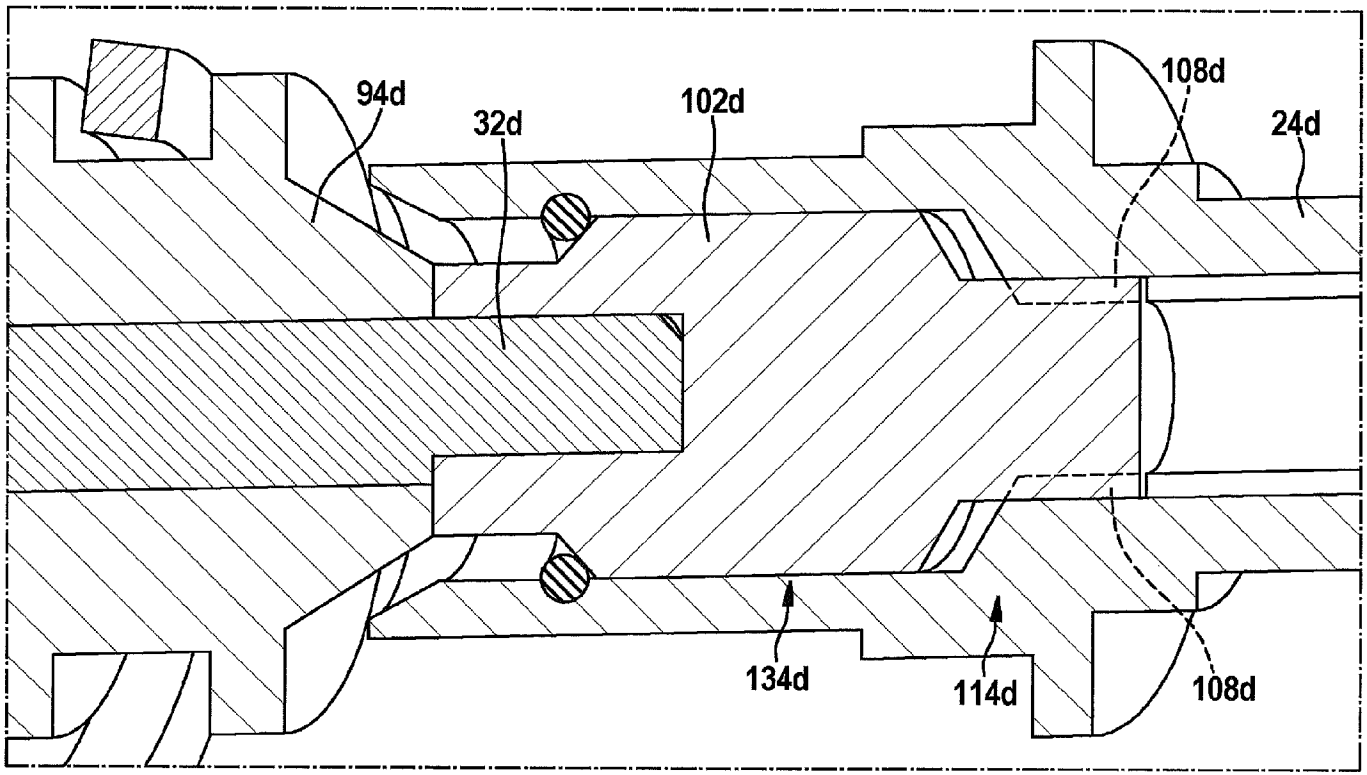
FIG. 7 shows a third alternative exemplary embodiment of a snap die of the hammer mechanism from FIG. 1 in a sectional view.
Figure 8:
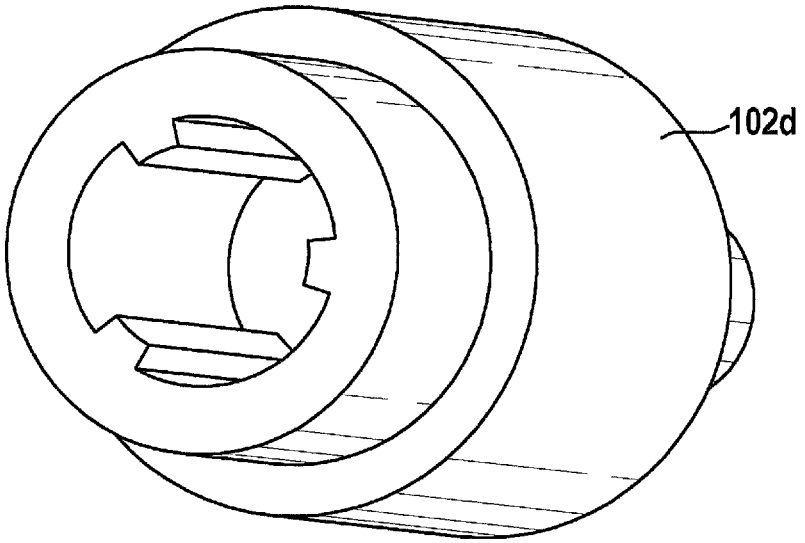
FIG. 8 shows the snap die from FIG. 7 in a first perspective view.
Figure 9:
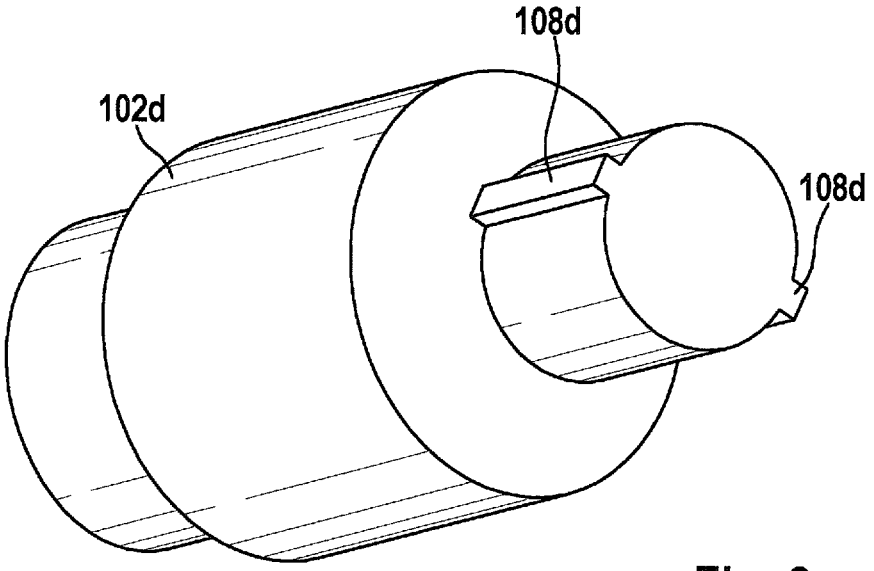
FIG. 9 shows the snap die from FIG. 7 in a second perspective view.
Figure 10:
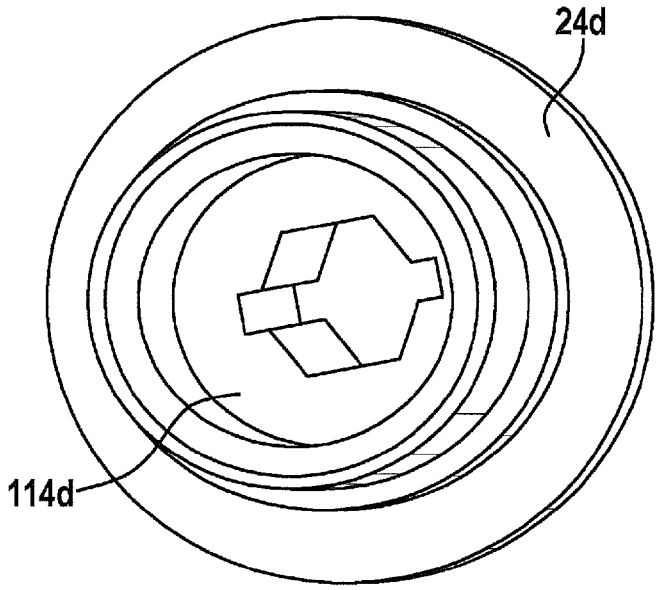
FIG. 10 shows a portion of a clamping chuck of the hammer mechanism of FIG. 7 in a perspective view.

FIG. 6, like FIG. 5, schematically illustrates a portion of hammer mechanism 22*c*. A hammer means 94*b* of an impact-generation unit 50*c* of hammer mechanism 22*c* is mounted in movable manner on a clamping chuck drive shaft 32*c* of hammer mechanism 22*c*. Clamping chuck drive shaft 32*c* is joined to a snap die 102*b* of hammer mechanism 22*c* in torsionally fixed and axially displaceable manner. Snap die 102*c* includes a coupling means 108*c*, which forms a torsionally fixed connection to a clamping chuck 24*c* of hammer mechanism 22*c* in at least one operating state. Clamping chuck 24*c* has an inserted-tool coupling region 112*c*, in which coupling means 108*c* of snap die 102*c* engages at least partially. Inserted-tool coupling region 112*c* is provided to produce forces on an inserted tool in the peripheral direction during operation. In an operative state, coupling means 108*c* is at least partially disposed inside a tapered region 114*c* of clamping chuck 24*c*. Coupling means 108*c* is developed as an external hexagon. The dimensions of external hexagon correspond to the usual dimensions of a bit for screw-fitting operations. A sealing region 134*c* of the snap die 102*c* is resting against clamping chuck 24*c* without teeth and advantageously prevents dust from entering impact-generation unit 50*b* in a manner that is able to be produced in a cost-effective way. Especially fat loss is able to be minimized.

FIGS. 7 through 10 show a portion of a hammer mechanism 22*d*, also as a section and in a perspective view. A hammer means 94*d* of an impact-generation unit 50*d* of hammer mechanism 22*d* is movably mounted on a clamping chuck drive shaft 32*d* of hammer mechanism 22*d*. Clamping chuck drive shaft 32*d* is joined to a snap die 102*d* of hammer mechanism 22*d* in torsionally fixed and axially displaceable manner. Snap die 102*d* has a coupling means 108*d* which forms a torsionally fixed connection to a clamping chuck 24*d* of hammer mechanism 22*d* in at least one operating state. In an operative state, coupling means 108*d* is at least partially disposed inside a tapered region 114*d* of clamping chuck 24*d*.

Coupling means 108*d* is developed as teething with two coupling ribs that lie opposite each other in relation to the axis of rotation. Coupling means 108*d* has the same form and the same dimensions as a coupling means for coupling with an inserted tool. The form and the dimensions correspond to those of the SDS Quick standard. A sealing region 134*d* of snap die 102*d* is resting against clamping chuck 24*d* without teething.

Figure 11:
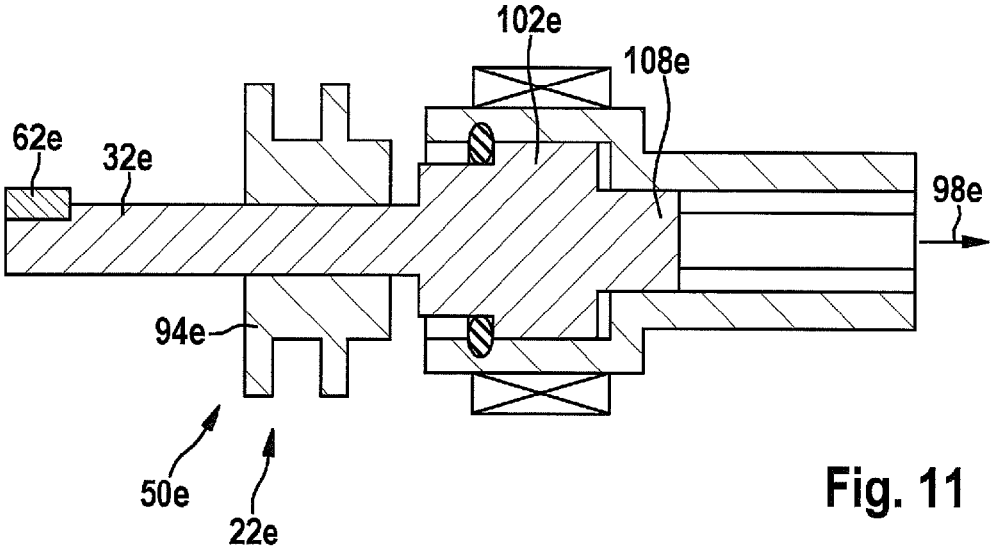
FIG. 11 shows a fourth alternative exemplary embodiment of a snap die of the hammer mechanism from FIG. 1 in a schematic representation.

FIG. 11, like FIG. 5, schematically illustrates a portion of hammer mechanism 22*e*. A hammer means 94*e* of an impact-generation unit 50*e* of hammer mechanism 22*e* is mounted in movable manner on a clamping chuck drive shaft 32*e* of hammer mechanism 22*e*. Clamping chuck drive shaft 32*e* is joined to a snap die 102*e* of hammer mechanism 22*e* in torsionally and axially fixed manner. Clamping chuck drive shaft 32*e* and snap die 102*e* are developed in one piece. In a strike, hammer means 94*e* moves both clamping chuck drive shaft 32*e* and snap die 102*e* in strike direction 98*e*. By way of a coupling means 62*e*, clamping chuck drive shaft 32*e* is connected in axially displaceable and torsionally fixed manner to a planetary-gear stage described in the exemplary embodiment of FIGS. 1 through 4.

What is claimed is:

1. A hammer mechanism, comprising:

at least one impact-generation unit including a hammer mechanism shaft; and a clamping chuck drive shaft, wherein the at least one impact-generation unit includes a spur-gear transmission stage adapted to translate a rotational speed of the clamping chuck drive shaft into a higher rotational speed of the hammer mechanism shaft for an impact generation.

2. The hammer mechanism as recited in claim 1, wherein:

the at least one impact-generation unit includes a hammer mechanism shaft, and the hammer mechanism shaft includes an axis of rotation situated adjacent to the clamping chuck drive shaft in a radial direction.

3. The hammer mechanism as recited in claim 2, wherein the at least one impact-generation unit includes at least one bearing for mounting the hammer mechanism in an axially fixated manner.

4. The hammer mechanism as recited in claim 1, wherein the at least one impact-generation unit includes a hammer element mounted by the clamping chuck drive shaft in a manner allowing movement in a strike direction in at least one operating state.

5. The hammer mechanism as recited in claim 4, wherein the clamping chuck drive shaft penetrates the hammer element at least partially.

6. The hammer mechanism as recited in claim 4, further comprising:

a coupling element connected to the clamping chuck drive shaft in a torsionally fixed manner and for driving the at least one impact-generation unit.

7. The hammer mechanism as recited in claim 1, further comprising:

a bearing for mounting the clamping chuck drive shaft in an axially displaceable manner.

8. The hammer mechanism as recited in claim 1, further comprising:

a planetary gearing for driving the clamping chuck drive shaft in at least one operating state.

9. The hammer mechanism as recited in claim 1, further comprising:

a clamping chuck; and a snap die including a coupling element for transmitting a rotary motion to the clamping chuck.

10. A hammer mechanism, comprising:

at least one impact-generation unit a clamping chuck;

a clamping chuck drive shaft a snap die including a coupling element for transmitting a rotary motion to the clamping chuck; and an impact-generation deactivation unit including a blocking element for acting on the snap die parallel to at least one force of the clamping chuck drive shaft in at least a drilling operation, wherein the at least one impact-generation unit includes a spur-gear transmission stage adapted to translate a rotational speed of the clamping chuck drive shaft into a higher rotational speed of the hammer mechanism shaft for an impact generation.

11. A handheld tool, comprising:

a hammer mechanism, comprising:

at least one impact-generation unit including a hammer mechanism shaft, and a clamping chuck drive shaft, wherein the at least one impact-generation unit includes a spur-gear transmission stage adapted to translate a rotational speed of the clamping chuck drive shaft into a higher rotational speed of the hammer mechanism shaft for an impact generation.

* * * * *